US007421862B2

(12) United States Patent
Lyu

(10) Patent No.: US 7,421,862 B2
(45) Date of Patent: Sep. 9, 2008

(54) WASHING MACHINE WITH TEMPERATURE SENSOR ARRANGEMENT

(75) Inventor: Jae Chul Lyu, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 403 days.

(21) Appl. No.: 10/469,159

(22) PCT Filed: Dec. 27, 2002

(86) PCT No.: PCT/KR02/02445

§ 371 (c)(1),
(2), (4) Date: Aug. 26, 2003

(87) PCT Pub. No.: WO03/056094

PCT Pub. Date: Jul. 10, 2003

(65) Prior Publication Data

US 2004/0206132 A1 Oct. 21, 2004

(30) Foreign Application Priority Data

Dec. 27, 2001 (KR) ..... 2001-86105
Dec. 27, 2001 (KR) ..... 2001-86106

(51) Int. Cl.
*D06F 33/00* (2006.01)
*D06F 37/00* (2006.01)

(52) U.S. Cl. ..... 68/12.03; 68/208

(58) Field of Classification Search ..... 68/12.02–12.03, 68/12.19, 12.21, 12.22, 23 R, 12.01, 208
See application file for complete search history.

(56) References Cited

U.S. PATENT DOCUMENTS 4,935,621 A * 6/1990 Pikulski ..... 250/229
5,133,200 A 7/1992 Tanaka et al.
5,241,845 A * 9/1993 Ishibashi et al. ..... 68/12.02
5,347,610 A 9/1994 Lee
5,377,299 A * 12/1994 Anson et al. ..... 392/447
5,394,582 A 3/1995 Moon
5,603,233 A * 2/1997 Erickson et al. ..... 68/12.02
5,881,578 A 3/1999 Proppe et al.
6,640,637 B2 * 11/2003 Baek ..... 73/652
6,691,536 B2 * 2/2004 Severns et al. ..... 68/12.27

(Continued)

FOREIGN PATENT DOCUMENTS

CN 1075993 9/1993

(Continued)

OTHER PUBLICATIONS

European Office Action dated Dec. 19, 2006.

*Primary Examiner*—Joseph L Perrin
(74) *Attorney, Agent, or Firm*—McKenna Long & Aldridge LLP

(57) ABSTRACT

Washing machine including a cabinet, a water storage tub mounted in the cabinet, the water storage tub having a water storage space therein and a drain hole for draining washing water in the water storage space, a supporter fitted between the cabinet and the water storage tub for supporting the water storage tub, and a sensor for sensing information on the water storage space, the senor fitted to an outside of the water storage tub for prevention of leakage of the washing water, thereby providing interchangeability between washing machines with or without the sensor fitted to the water storage tub.

10 Claims, 5 Drawing Sheets

U.S. PATENT DOCUMENTS

| | | | | |
|---|---|---|---|---|
| 6,898,951 | B2 * | 5/2005 | Severns et al. | 68/5 C |
| 6,935,142 | B2 * | 8/2005 | Musser et al. | 68/12.16 |

FOREIGN PATENT DOCUMENTS

| | | | |
|---|---|---|---|
| DE | 36 06 323 | A1 | 8/1987 |
| DE | 3603323 | A1 | 8/1987 |
| DE | 10011692 | A1 | 9/2001 |
| EP | 0 222 264 | A | 5/1987 |
| EP | 1 087 052 | A2 | 3/2001 |
| GB | 2217110 | A | 10/1989 |
| JP | 04122385 | | 4/1992 |
| KR | 10-1990-0000533 | | 1/1990 |
| KR | 10-1993-0008226 | | 5/1993 |
| KR | 100208175 | B1 | 4/1999 |

* cited by examiner

WASHING MACHINE WITH TEMPERATURE SENSOR ARRANGEMENT

TECHNICAL FIELD

The present invention relates to washing machines, and more particularly, to a washing machine having a sensor for sensing information on a space in which a wash is made.

BACKGROUND ART

The washing machine conducts washing, rinsing and spinning processes for removal of dirt stuck to clothes by means of action of detergent and water. In the washing machines, there are drum type, agitator type and pulsator type washing machines.

The drum type washing machine carries out washing by introducing washing water, the detergent and the laundry into an inside of a drum having a plurality of tumbling ribs on an inside surface of the drum, and rotating the drum around a horizontal shaft slowly, to lift/drop the laundry with the tumbling ribs that gives impact to the laundry to wash the laundry. Though the drum type washing machine has advantages in that it gives almost no damage to the laundry and has a small water consumption, the drum type washing machine has disadvantages in that it has a low washing capability to required heating of the washing water for enhancing the low washing capability, with consequential large power consumption, requires a long time for washing, and has much noise.

The agitator type washing machine, carrying out washing by rotating a washing rod projected upward from a central part of the washing tub in left/right directions, has disadvantages in that it has great noise and vibration and damages laundry, though it has an excellent washing capability. In general, such an agitator type is suitable for a large sized washing machine.

The pulsator type carries out washing with friction between water circulation caused by a disk like pulsator on a bottom of a washing tub and the laundry. The greatest advantages of the pulsator type washing machine are short washing time period and large capacity washing machine can be fabricated, and the pulsator type washing machine has relatively low noise and vibration, and costs low. Though the pulsator type washing machine has disadvantages in that it has entangling of laundry, and gives relatively much damage to the laundry, the pulsator type washing machines are spread wider gradually as above problems are corrected and performance is improved recently owing to technical improvements, such as elimination of the clutch, employing a direct driving type, and the like.

A system of a general washing machine, particularly to the pulsator type washing machine will be explained. An outside of the washing machine is a cabinet. The cabinet has a water storage tub supported on a supporter in an inside thereof. Washing water is filled inside of the water storage tub.

There is an open/closable cover on top of the cabinet. There is a drain opening passed through one side of the water storage tub, to which a drain hose is connected for draining washing water from the water storage tub to an outside of the washing machine.

There is a washing tub rotatably mounted in the water storage tub. The washing tub has a plurality of pass through holes for communication with the water storage tub. Washing is carried out in the washing tub, actually. The pulsator is mounted on a bottom of the washing tub, for rotation together with, or independent from the washing tub.

The rotation of the washing tub and the pulsator is carried out by a motor mounted under the water storage tub. The motor is provided with a rotor for selective rotation of the washing tub and the pulsator, and a stator for making the rotor to rotate by magnetic reaction with the rotor.

In the meantime, for adding various functions to and improving performance of the washing machine, a sensor may be fitted for sensing information (for an example, a temperature) on an inside of the washing tub. A general structure of the sensor fitted to the water storage tub is illustrated in FIG. 1. Referring to FIG. 1, there is a pass through hole 1*a* in the water storage tub 1, through which a fore end of a sensor 2 is exposed to an inside of the water storage tub 1. For firm fixation of the sensor 2, the sensor 2 has a mounting plate 4 fastened to a fastening boss 3 by fastening screws 5. For prevention of washing water leakage through the pass through hole 1*a* for the sensor 2, there is a sealing material 3*a* applied between the mounting plate 4 and the water storage tub 1.

However, the washing machine with the foregoing sensor 2 mounting structure has the following problems.

First, the making of the pass through hole 1*a* in the water storage tub 1 for fitting the sensor requires application of the sealing material 3*a* for prevention of water leakage through the pass through hole. Moreover, the leakage may cause short circuit or electric shock since the sensor 2 is in general operative on electricity.

Second, the washing machine with the sensor 2 fitted thereto is a high class product with relatively many functions and improved function, but with not so many kinds and demands. Accordingly, there is a problem that separate design and fabrication is required for the water storage tub 1 with the pass through hole 1*a*, even if there is not so many kinds and demands of the washing machine.

DISCLOSURE OF INVENTION

An object of the present invention for solving the foregoing problems is to provide a washing machine having a sensor fitting structure without possibility of washing water leakage.

Another object of the present invention is to provide a washing machine having a sensor fitting structure, which permits fabrication of a washing machine with or without the sensor by applying identical water storage tub thereto.

Further object of the present invention is to provide a washing machine having a sensor fitting structure, which permits easy assembly on a production line.

Still further object of the present invention is to provide a washing machine having a sensor fitting structure, which permits easy arrangement of sensor lines.

The object of the present invention can be achieved by providing a washing machine including a cabinet, a water storage tub mounted in the cabinet, the water storage tub having a water storage space therein and a drain hole for draining washing water in the water storage space, a supporter fitted between the cabinet and the water storage tub for supporting the water storage tub, and a sensor for sensing information on the water storage space, the senor fitted to an outside of the water storage tub for prevention of leakage of the washing water.

The sensor is fitted to the outside of the water storage tub for sensing information on the water storage space, indirectly. To do this, the water storage tub includes a pocket formed in the outside surface to project toward the water storage space for putting the sensor therein. The pocket is formed in a bottom of the water storage tub. It is preferable that the pocket is projected toward the water storage space from an inside surface of the water storage tub to a height of 8~13 mm, and has a thickness in a range of 0.7~1.7 mm between the inside surface and the outside surface of the water storage tub.

The washing machine further includes a fixing plate which is a wide extension from an outside surface of the sensor fixed to the outside surface of the water storage tub, for fixing the sensor. For this, it is preferable that the water storage tub includes bosses projected from the outside surface of the water storage tub for fastening the fixing plate thereto.

Alternatively, the sensor is fitted to an outside of the water storage tub such that the sensor is in direct contact with the washing water, for indirect measurement of information on the water storage space. For this, the washing machine further includes an adapter connected between the drain hole and a drain hose on an outside of the water storage tub, the adapter having a pass through hole formed in one side thereof for fitting the sensor through the pass through hole. The sensor is fitted such that a fore end of the sensor is positioned inside of the adapter which is in communication with the water storage space. The pass through hole has a sealing member fitted thereto for prevention of washing water leakage. The sealing member includes a middle part inserted between the pass through hole and the sensor, and both ends seated on an inside surface and an outside surface of the adapter, respectively. The adapter includes a flat part in the vicinity of the pass through hole for close seating of the both ends of the sealing member.

The washing machine further includes a water protection fence extended from one side of the adapter for protection of splash of the washing water. The washing machine further includes a hose hanger at one side of the water protection fence for temporary hanging of the drain hose during assembly. The hose hanger is a bend in a form of a hook formed at one side of the water protection fence positioned opposite to the adapter.

The washing machine further includes a wire hanger projected from one side of the water protection fence for hanging the interconnection to the sensor.

The washing machine further includes a fastening piece extended from the water protection fence so as to be fastened to the water storage tub for fixing the water protection fence. The water storage tub includes a fastening boss projected from the outside surface thereof for fastening the fastening piece thereto.

The sensor may be a thermistor.

BRIEF DESCRIPTION OF DRAWINGS

The accompanying drawings, which are included to provide a further understanding of the invention, illustrate embodiments of the invention and together with the description serve to explain the principles of the invention.

In the drawings.

BEST MODE FOR CARRYING OUT THE INVENTION

Figure 1:
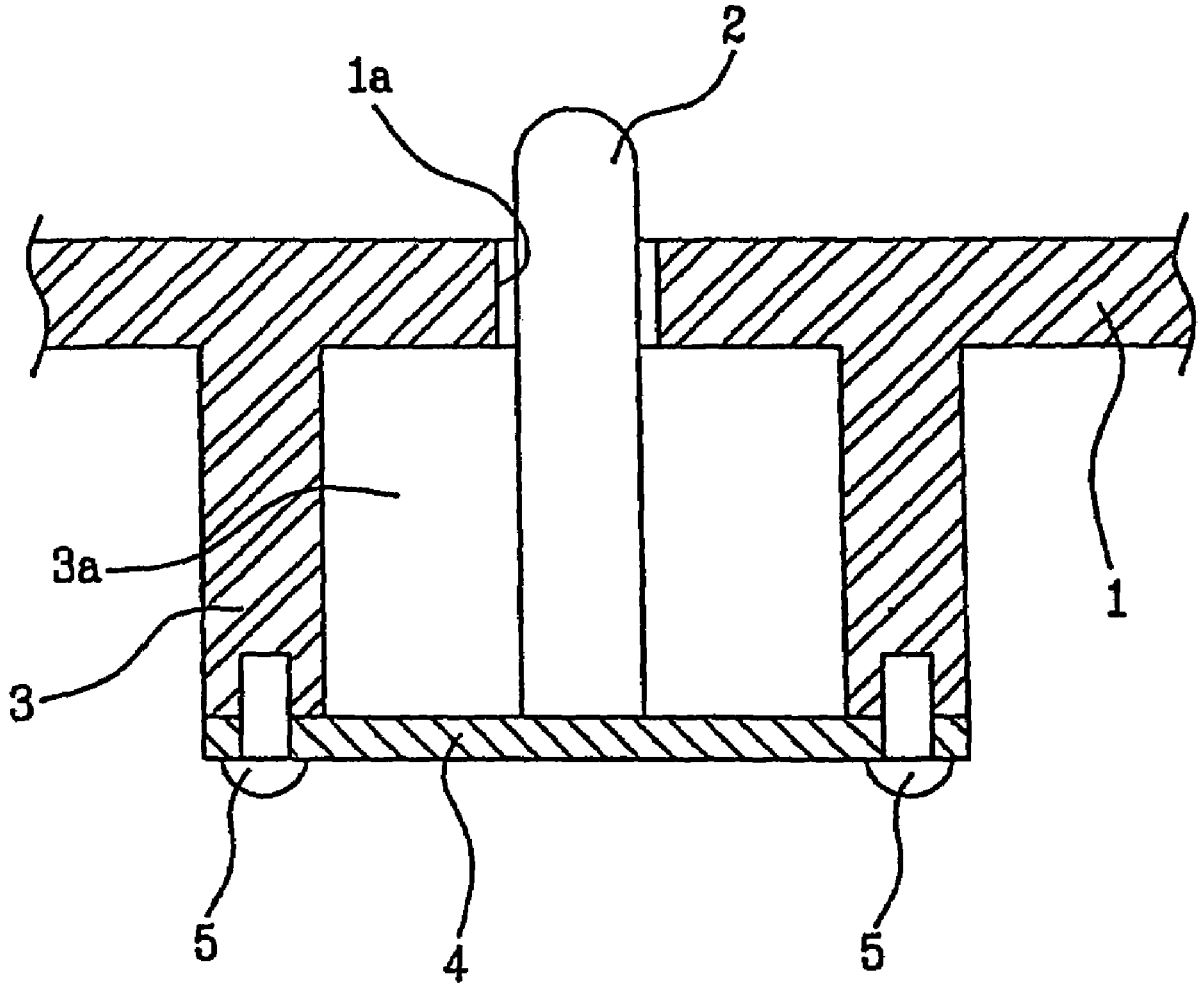
RELATED ART FIG.1
FIG. 1 illustrates a section of a related art sensor fitting structure in a washing machine.
Figure 2:
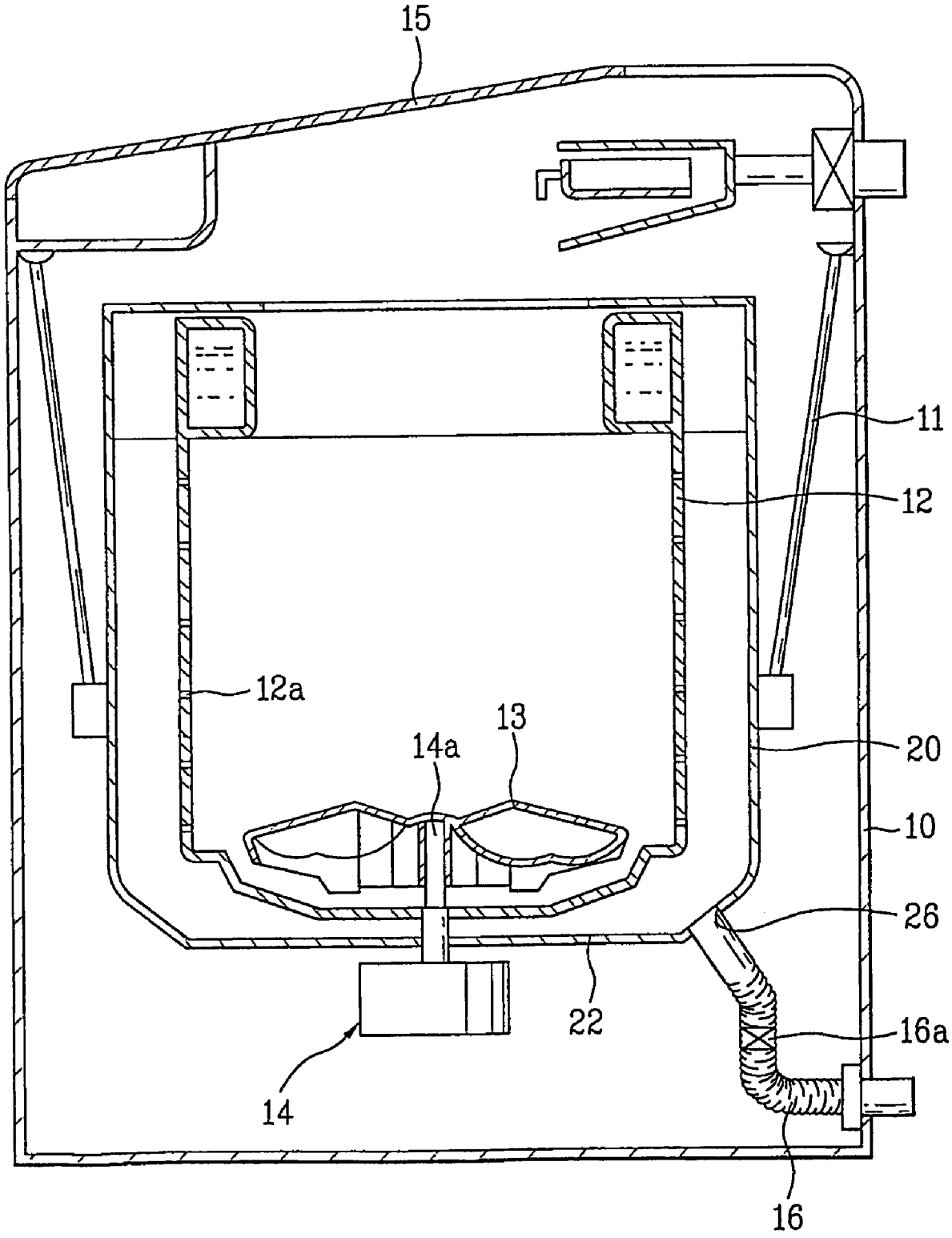
FIG. 2 illustrates a section of a washing machine, schematically.

Reference will now be made in detail to the preferred embodiments of the present invention, examples of which are illustrated in the accompanying drawings. FIG. 2 illustrates a section of a washing machine, schematically.

Referring to FIG. 2, the washing machine of the present invention also includes a cabinet 10, a water storage tub 20, supporters 11, a washing tub 12, and a pulsator 13 and a motor 14.

The cabinet 10 forms an outside shape of the washing machine. There is an open/closable cover 15 on top of the cabinet 10. The water storage tub 20 is cylindrical with a water storage space 21 formed therein, and mounted inside of the cabinet 10. There is a drain hole 26 passed through one side of the water storage tub 20 for draining the washing water. There is a drain hose 16 connected to the drain hole 26, and a valve 16*a* fitted thereto for open/closing a flow passage.

Each of the supporters 11 has two ends respectively connected to an inside surface of the cabinet 10 and an outside surface of the water storage tub 20 for supporting the water storage tub 20. The washing tub 12 is rotatably mounted inside of the water storage tub 20, and has a plurality of pass through holes 12*a* for communication with the water storage tub 20. The motor 14 is mounted under the water storage tub 20, for rotating the washing tub 12 and the pulsator 13 respectively. For this, the motor 14 has a rotating shaft 14*a* passed through the water storage tub 20 and connected with the washing tub 12 and the pulsator 13.

Though the washing machine of the present invention is as shown in FIG. 2, different from the related art in which the sensor 2 directly passes through the water storage tub 1, the fitting structure of the sensor 30 to the water storage tub 20 of the present invention has the sensor 2 fitted to an outside of the water storage tub 20 for sensing the water storage space 21, for prevention of washing water leakage.

Figure 3:
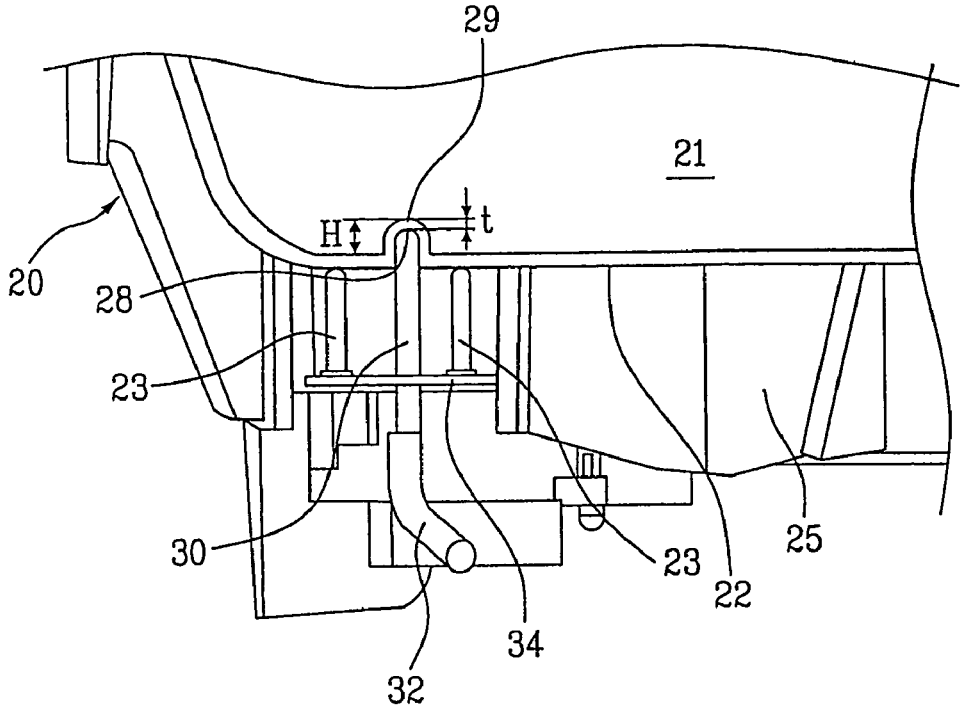
FIG. 3 illustrates a section of a sensor fitting structure in a washing machine in accordance with a first preferred embodiment of the present invention.
Figure 4:
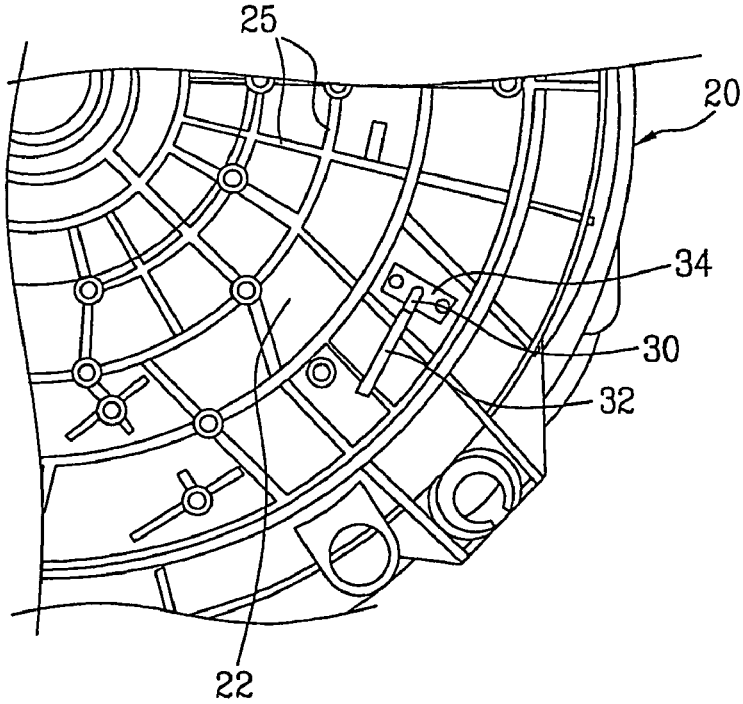
FIG. 4 illustrates a partial bottom view of a water storage tub showing a sensor fitting structure in a washing machine in accordance with a first preferred embodiment of the present invention.

The sensor fitting structure in accordance with a first or second preferred embodiment of the present invention will be explained with reference to FIGS. 3~7. In explaining the preferred embodiments, same parts will be given the same names and reference symbols and iterative explanations of which will be omitted. FIGS. 3 and 4 show the sensor fitting structures in accordance with the first preferred embodiment of the present invention.

In the first preferred embodiment of the present invention, a sensor 30 is fitted to an outside surface of the water storage tub 20, for indirect detection of information on a water storage space 21. To do this, a pocket 28 is formed in the outside surface of the water storage tub 20, preferably, in the outside surface of a bottom 22 of the water storage tub, and the sensor 30 is inserted in the pocket 28. As shown in FIG. 3, the pocket 28 is concave when it is seen from an outside of the water storage tub, and convex when it is seen from the water storage space 21, to form a projection 29 in the water storage space 21. The unexplained numeral 25 denotes reinforcing ribs for reinforcing strength of the water storage tub 20.

It is preferable that the projection 29 has a height H of approx. 8~13 mm with reference to an inside surface of the water storage tub 20. Though the deeper the pocket 28, i.e., the higher the projection, the more favorable for sensing information on the water storage space 21, for an example, a temperature of the washing water, considering formability in fabrication and strength during use in overall, it is preferable that the height H has a value suggested above.

It is preferable that the pocket 28 has a thickness 't' in a range of 0.7~1.7 mm between the inside surface and the outside surface of the water storage tub in a pocket 28 part. Though the thinner the thickness, the more favorable for sensing information on the water storage space 21, for an example, a temperature of the washing water, the strength and height H of the projection 29 limits reduction of the thickness. Opposite to this, though the thicker the thickness, the more unfavorable for sensing information on the water storage space 21, it is favorable for the strength of the projection 29. Therefore, putting all parameters together, the present invention suggests the thickness of the pocket 28 as above.

It is preferable that the sensor 30 is fitted such that a fore end of the sensor 30 is inserted in the pocket 28 from the outside surface of the bottom 22 of the water storage tub, and an interconnection 32 is provided between the sensor 30 and a controller (not shown) for providing information the sensor sensed to the controller. The sensor 30 fitted thus measures information on the water storage space 21 through the water storage tub 20, indirectly.

The washing water temperature is one of example of information that can be measured by above method. When the washing water temperature is measured by using the sensor 30, a thermistor which has a resistance varied with a temperature may be used as the sensor 30. When the thermistor is employed as the sensor 30, the washing water temperature can be known indirectly through the resistance of the thermistor provided as the thermistor reacts to a temperature of the water storage tub 20 receiving heat of the washing water until thermal equilibrium with the washing water is made.

For more accurate measurement of the information on the water storage space 21 by above indirect method, construction of an accurate and reliable data base through many experiments is required.

In the meantime, in the first preferred embodiment of the present invention, a fixing plate 34 is further included for fixing the sensor 30, firmly. The fixing plate 34 is a wide extension from an outside surface of the sensor 30 fixed to the outside surface of the water storage tub 20, for firm fixation of the sensor 30. To do this, it is preferable that there are lengths of bosses 23 extended from the outside surface of the water storage tub 20, for fastening the fixing plate 34 to the bosses 23.

In the washing machine having the foregoing sensor fitting structure in accordance with the first embodiment of the present invention, the sensor 30 senses the information on the water storage space 21 by the following method.

At first, the sensor 30 is fitted to the outside surface of the water storage tub 20 firmly as the sensor 30 is inserted into the pocket 28 in the water storage tub 20 from the fore end, and the fixing plate 34 seated on the bosses 23 are fastened with screws. Once the sensor 30 is fitted thus, the sensor 30 can receive the temperature of the water storage tub 20 with easy because the fore end of the sensor 30 is in close contact with the pocket 28 in the water storage tub 20.

In the meantime, since heat of the washing water is transferred from the water storage space 21 to the water storage tub 20, there is a thermal equilibrium set between the washing water and the water storage tub 20, together with the pocket 28. Accordingly, even if the sensor 30 is fitted to the outside surface of the water storage tub 20, the heat transmitted from the washing water to the sensor 30, indirectly. Eventually, in the first preferred embodiment of the present invention, the washing water temperature can be measured indirectly by above principle of the zeroth law of thermodynamics.

If the sensor 30 is a thermistor, resistance of the sensor 30 varies with a heat received. The resistance is transferred from the sensor 30 to the controller through the interconnection 32, and the controller picks up a temperature corresponding to the resistance from the data base stored already, thereby becoming to know the washing water temperature.

In order to enhance an accuracy of the measurement despite of the indirect measurement of the washing water temperature through the water storage tub 20, it is required to make a contact area between the sensor 30 and the pocket 28 greater. Therefore, it is required to design the height H of the projection 29 and the thickness 't' of the pocket enough to derive an accurate measurement value.

Different from the related art, the first preferred embodiment of the present invention for indirect measuring of the water storage space 21 can dispense with the pass through hole in the water storage tub 20 and the sealing material for prevention of leakage. Thus, the first preferred embodiment of the present invention has no problem of water leakage from a sensor 30 fit part, at all.

According to the first preferred embodiment of the present invention, even in a case of washing machine without the sensor 30, only one kind of water storage tub 20 may be mass produced, and used for the washing machine without the sensor 30 or the washing machine with the sensor 30, just by not fitting, or fitting the sensor 30 to the water storage tub 20.

Figure 5:
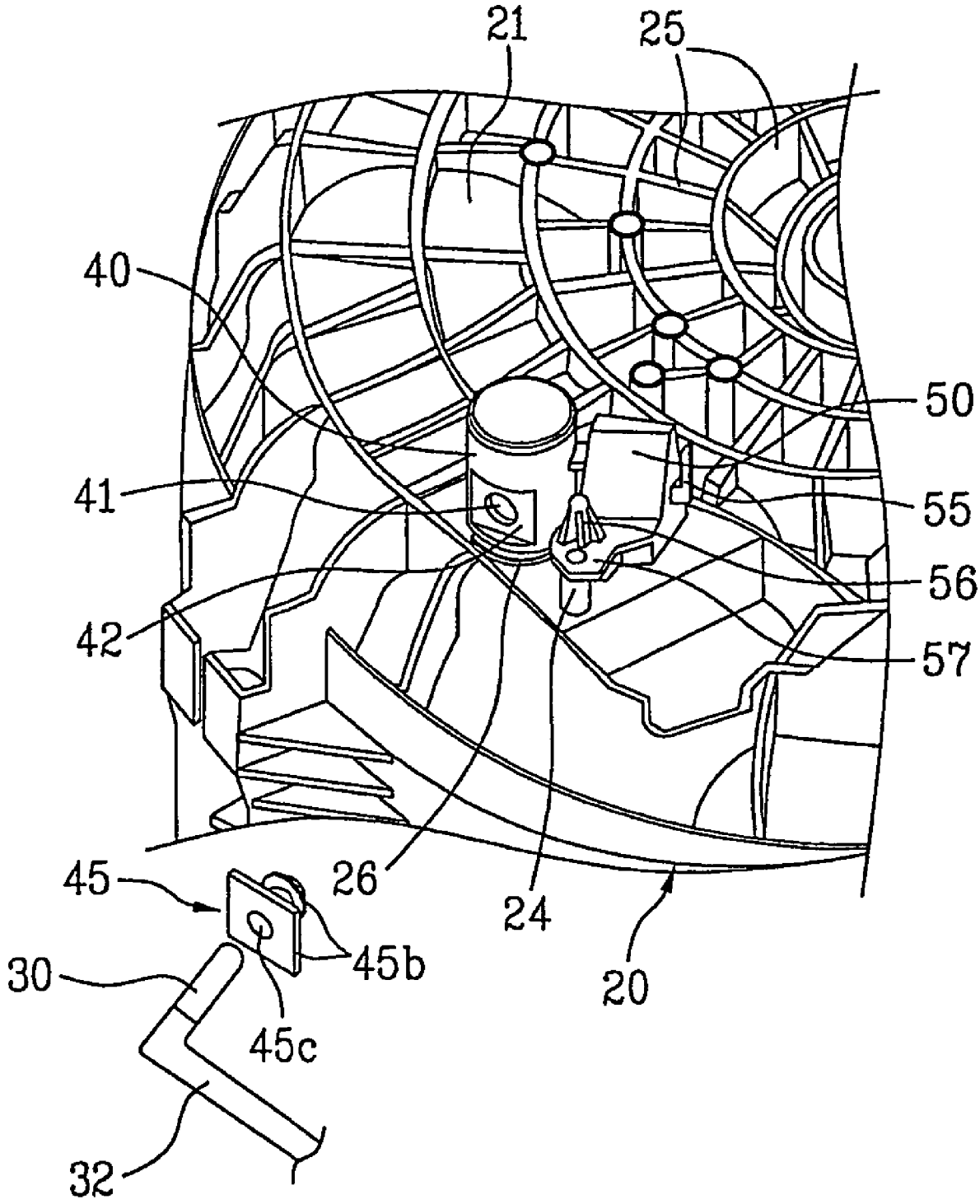
FIG. 5 illustrates a partial bottom perspective view of a water storage tub showing a sensor fitting structure in a washing machine in accordance with a second preferred embodiment of the present invention.
Figure 6:
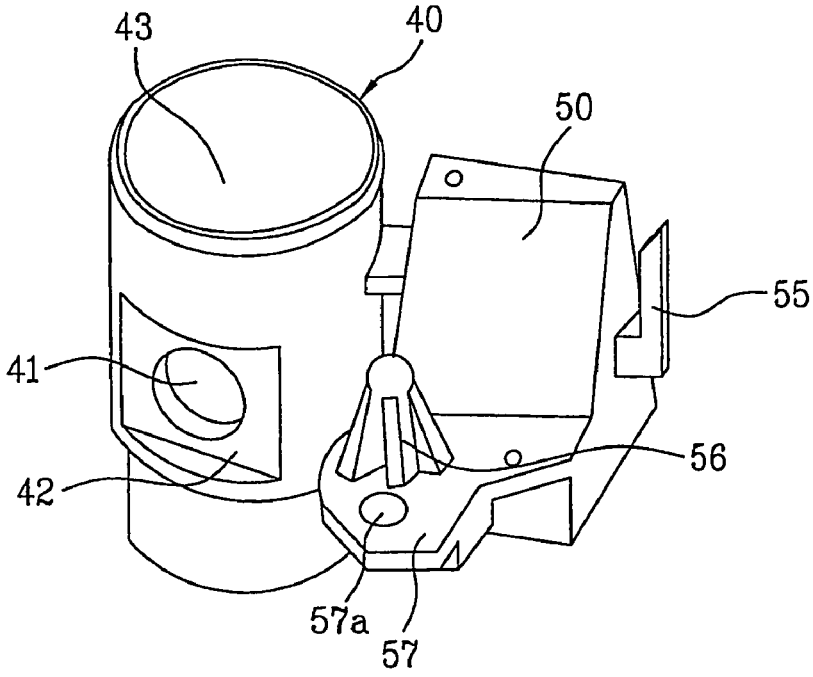
FIG. 6 illustrates a perspective view of an assembly of an adapter and a water protection fence in a washing machine in accordance with a second preferred embodiment of the present invention.
Figure 7:
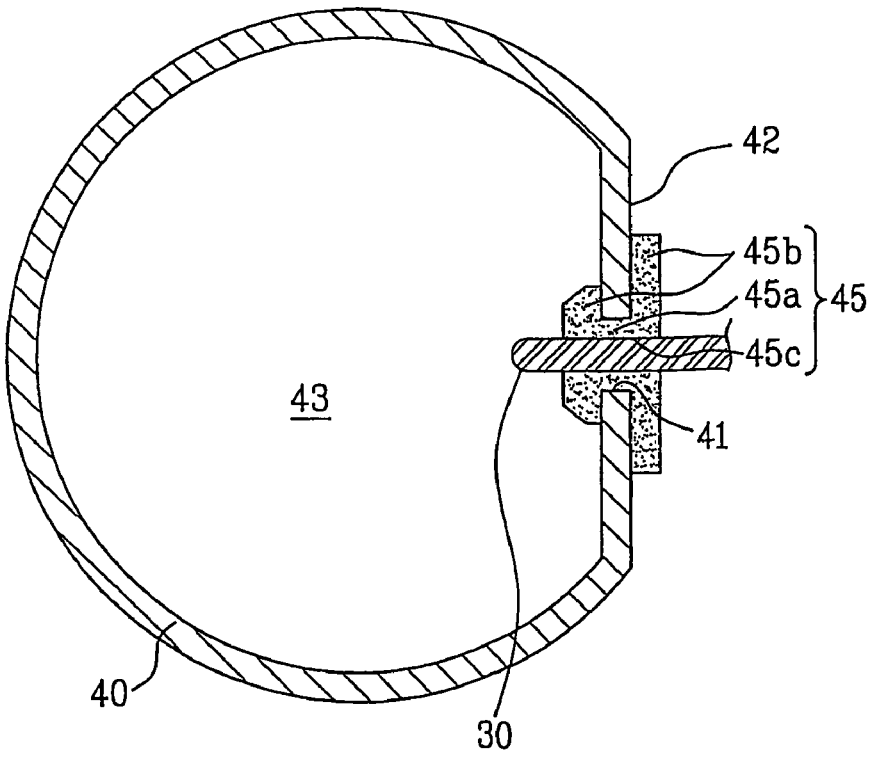
FIG. 7 illustrates a section showing a sensor fitted to an adapter in a washing machine in accordance with a second preferred embodiment of the present invention.

FIGS. 5~7 illustrate a sensor fitting structure in a washing machine in accordance with a second preferred embodiment of the present invention, wherein a sensor 30 is fitted to be in direct contact with the washing water on an outer side of the water storage tub 20 for indirect measurement of the water storage space 21.

For this, a cylindrical adapter 40 with a draining passage 43 formed thereon is further provided, having two ends connected to the drain hole 26 and the drain hose 16 on an outside of the water storage tub 20, respectively. Once the adapter 40 is connected, the water storage space 21, an inside space of the water storage tub 20, and the draining passage 43, an inside space of the adapter 40, become in communication. The adapter 40 has a pass through hole 41 in one side, in which the sensor 30 is fitted. The sensor 30 is fitted such that a fore end of the sensor 30 is positioned inside of the adapter 40 in communication with the water storage space 21, i.e., in the draining passage 43.

The sensor 30 fitted thus measures information on the water storage space 21, for an example, the washing water temperature. When the sensor 30 is provided for measurement of a temperature, the sensor 30 may be a thermistor as described in the first preferred embodiment of the present invention with reference to FIGS. 3 and 4. The reference numeral 25 denotes reinforcing rib, for reinforcing a strength of the water storage tub 20.

There is a sealing member 45 fitted between the sensor 30 and the pass through hole 41 for prevention of washing water leakage. The sealing member 45 includes a middle part 45*a* having a central pass through hole 45*c*, and one pair of flange parts 45*b* at both ends thereof. As shown in FIG. 7, the sealing member 45 is fitted such that the flange parts 45*b* are seated on inside and outside of the adapter 40, respectively. As the sensor 30 is press fit through the hole 45*c* in the middle part 45*a*, the second preferred embodiment of the present invention requires no separate fixing structure for fitting the sensor 30 in position.

The second embodiment of the present invention suggests a structure in which the flange parts 45*b* of the sealing member 45 come into close contact with the inside surface and outside surface of the adapter 40. That is, the adapter 40 includes a flat part 42 in the vicinity of the pass through hole 41 for close seating of the flange parts 45*b* of the sealing member 45 on the outside surface and the inside surface of the flat part 42.

In the meantime, the second preferred embodiment of the present invention further includes a water protection fence 50 extended from one side of the adapter 40 for protection of splash of the washing water. The water protection fence 50 formed thus prevents water splashed under the water storage tub 20 to splash to electric fittings, such as the motor 14. It is preferable that the water protection fence 50 is formed as a unit with the adapter 40.

The water protection fence 50 further includes a hose hanger 55 at one side, for temporary hanging of the drain hose 16 during assembly. As shown in FIG. 6, the hose hanger 55 is a bend in a form of hook fitted to one side of the water protection fence 50 opposite to the adapter 40. Since one end of the drain hose 16 disconnected from the drain hole 26 can be hung on the hose hanger 55 temporarily, the assembly becomes very convenient.

The water protection fence 50 further includes a wire hanger 56 at another side of the water protection fence 50, projected upward in a form of bar from another side of the water protection fence 50 for hanging or winding wire 32 connected to the sensor 30.

The second preferred embodiment of the present invention further includes a fastening piece 57 for fixing the water protection fence 50 to the water storage tub 20. As shown in FIG. 6, the fastening piece 57 is a wide extension from another side of the water protection fence 50 in which a fastening hole 57*a* is formed to pass through the fastening piece 57.

In the meantime, for easy fastening of the fastening piece 57 and the water storage tub 20, there is a fastening boss 24 projected from the outside of the water storage tub 20, for an example, the outside surface of the bottom 22 of the water storage tub, for fasting the fastening boss 24 and the fastening piece 57 with screw or the like. Once the fastening piece 57 is fastened to the fastening boss 24, the adapter 40 and the water protection fence 50 is fixed to the water storage tub 20, firmly.

In the washing machine having a sensor fitting structure in accordance with a second preferred embodiment of the present invention, the sensor 30 is, not fitted to the water storage tub 20 directly, but fitted to the adapter 40 in communication with the water storage space 21 in the water storage tub 20, for indirect measurement of the information on the water storage space 21, for an example, the washing water temperature, which will be explained in detail.

Once the adapter 40 having the sensor 30 fitted thereto is connected between the drain hole 26 and the drain hose 16, the water storage space 21 in the water storage tub 20 and the drain passage 43 in the adapter 40 and an inside of the drain hose 16 are in communication. As shown in FIG. 2, since the valve 16*a* is on the drain hose 16, when the valve 16*a* closes the inside passage of the drain hose 16, the washing water in the water storage tub 20 also fills the drain passage 43 of the adapter 43. Since the washing water is filled inside of the drain passage 43, an inside space of the adapter 40, thus, the sensor 30 can be in contact with the washing water from an outside of the water storage tub 20.

In the meantime, the temperature of the washing water filled in the water storage space 21 maintains a thermal equilibrium with the washing water filled in the drain passage 43 in the adapter 40 by the zeroth law of thermodynamics, a thermal equilibrium law. Eventually, heat is transferred from the water storage space 21 to the sensor 30, and the sensor 30 can measure the washing water temperature in the water storage tub 20 by the principle the same with the first preferred embodiment of the present invention described with reference to FIGS. 3 and 4.

Thus, the second embodiment of the present invention permits an accurate measurement of the washing water temperature filled in the water storage space 21 with the sensor 30 fitted to an outside of the water storage tub 20.

Different from the related art, the second preferred embodiment of the present invention for indirect measurement of the information on the water storage space requires no pass through hole formed in the water storage tub 20 for fitting the sensor 30. Therefore, according to the second preferred embodiment of the present invention, even in a case of washing machine without the sensor 30, only one kind of water storage tub 20 may be mass produced, and used for the washing machine without the senor 30 or the washing machine with the sensor 30, just by not fitting, or fitting the sensor 20 to the water storage tub 20.

Meanwhile, the second preferred embodiment of the present invention can prevent splash of the washing water to the motor 14 under the water storage tub 20 from the source as the water protection fence 50 is fitted to one side of the adapter 40, and can reduce components as the water protection fence 50 and the adapter 40 are fabricated as one unit.

The insertion of one end of the drain hose 16 in the hose hanger 55 during the assembly permits an accurate robot assembly work, since the washing machine under assembly can move along the assembly line, with the drain hose 16, not being shaky, but stationary.

Moreover, the second preferred embodiment of the present invention can prevent defective mounting of the sensor 30 or cutting of the interconnection in advance, because the wire hanger 56 permits the interconnection 32 connected to the sensor 30 to be hung on, or wound around the wire hanger 56, that prevents the interconnection 32 from being shaky during assembly or service.

The present invention which can be realized by means of the various embodiments permits to sense information on the water storage space 21 accurately comparatively, without making a hole in the water storage tub 20.

In describing the washing machine of the present invention, description of general operation of the washing machine, i.e., description of the process for carrying out washing and rinsing with a water circulation caused by rotation of the pulsator 13 and the washing tub 12, and a process for carrying out spinning after completion of the washing and rinsing, is identical to a related art washing machine, and will not be given, since it is known to a person skilled in the art.

Meantime, it will be apparent to those skilled in the art that various modifications and variations can be made in the present invention without departing from the spirit or scope of the invention.

For an example, though the present invention is described taking the pulsator type washing machine as an example, a person skilled in the art can apply the present invention to fields of washing machines, such as agitator type or drum type washing machines.

Thus, it is intended that the present invention cover the modifications and variations of this invention provided they come within the scope of the appended claims and their equivalents.

INDUSTRIAL APPLICABILITY

The present invention has the following advantages.

First, the same water storage tub can be applicable to any washing machine regardless of fitting of the sensor because no pass through hole is formed in the water storage tub for fitting the sensor.

Second, in the case of the first embodiment, there is no problem of leakage from the water storage tub because the sensor is fitted without making hole in the water storage tub.

Third, in the case of the second embodiment, assembly of the washing machine on a production line is made easy.

What is claimed is:

1. A washing machine comprising:

a cabinet;

a water storage tub mounted in the cabinet, the water storage tub having a water storage space therein and a drain hole for draining washing water in the water storage space;

a supporter fitted between the cabinet and the water storage tub for supporting the water storage tub;

a sensor for sensing the temperature of the washing water, wherein the entire sensor is positioned below a bottom of the water storage tub, and the sensor is in direct contact with the washing water drained out of the water storage tub;

an adapter connected between the drain hole and a drain hose, the adapter having a pass through hole formed on one side of the adapter, wherein the sensor is positioned within the pass through hole; and a water protection fence extended from one side of the adapter to protect an electrical connection of the sensor from contacting the washing water.

2. The washing machine as claimed in claim 1, wherein the sensor is fitted such that the fore end of the sensor is positioned inside of the adapter which is in communication with the water storage space.

3. The washing machine as claimed in claim 2, wherein the pass through hole has a sealing member fitted thereto for prevention of washing water leakage.

4. The washing machine as claimed in claim 3, wherein the sealing member includes;

a middle part inserted between the pass through hole and the sensor, and both ends seated on an inside surface and an outside surface of the adapter, respectively.

5. The washing machine as claimed in claim 4, wherein the adapter includes a flat part in the vicinity of the pass through hole for close seating of the both ends of the sealing member.

6. The washing machine as claimed in claim 1, further comprising a hose hanger at one side of the water protection fence for temporary hanging of the drain hose during assembly.

7. The washing machine as claimed in claim 6, wherein the hose hanger is a bend in a form of a hook formed at one side of the water protection fence positioned opposite to the adapter.

8. The washing machine as claimed in claim 6, further comprising a wire hanger projected from one side of the water protection fence for hanging the interconnection to the sensor.

9. The washing machine as claimed in claim 6, further comprising a fastening piece extended from the water protection fence so as to be fastened to the water storage tub for fixing the water protection fence.

10. The washing machine as claimed in claim 9, wherein the water storage tub includes a fastening boss projected from the outside surface thereof for fastening the fastening piece thereto.

* * * * *